US007540325B2

(12) United States Patent
Livingstone

(10) Patent No.: US 7,540,325 B2
(45) Date of Patent: Jun. 2, 2009

(54) WELL CEMENTING APPARATUS AND METHOD

(75) Inventor: James Livingstone, Calgary (CA)

(73) Assignee: Presssol Ltd., Calgary (CA)

( * ) Notice: Subject to any disclaimer, the term of this patent is extended or adjusted under 35 U.S.C. 154(b) by 32 days.

(21) Appl. No.: 11/308,452

(22) Filed: Mar. 27, 2006

(65) Prior Publication Data

US 2007/0084603 A1 Apr. 19, 2007

Related U.S. Application Data

(63) Continuation-in-part of application No. 11/308,263, filed on Mar. 14, 2006, now abandoned.

(51) Int. Cl.
*E21B 33/13* (2006.01)

(52) U.S. Cl. ..... 166/291; 166/285; 166/177.4

(58) Field of Classification Search ..... 166/285, 166/177.4, 291, 290; 175/215, 171
See application file for complete search history.

(56) References Cited

U.S. PATENT DOCUMENTS 3,524,503 A 8/1970 Baker et al.
3,621,910 A * 11/1971 Sanford et al. ..... 166/335
3,948,322 A 4/1976 Baker
4,413,682 A 11/1983 Callihan et al.
4,600,056 A * 7/1986 Burton, Jr. ..... 166/291
4,627,496 A * 12/1986 Ashford et al. ..... 166/292
4,682,661 A * 7/1987 Hughes et al. ..... 175/215
5,020,611 A * 6/1991 Morgan et al. ..... 175/215
5,040,602 A 8/1991 Helms
5,191,932 A 3/1993 Seefried et al.
5,348,089 A 9/1994 Brandell et al.
5,551,521 A * 9/1996 Vail, III ..... 175/65
5,890,538 A 4/1999 Beirute et al.
6,497,290 B1 * 12/2002 Misselbrook et al. ..... 166/384
6,668,923 B2 * 12/2003 Vincent et al. ..... 166/253.1
RE38,578 E 9/2004 Vercaemer et al.
7,343,983 B2 * 3/2008 Livingstone ..... 175/57
2003/0173088 A1 * 9/2003 Livingstone ..... 166/324
2003/0221829 A1 * 12/2003 Patel et al. ..... 166/278
2004/0016546 A1 * 1/2004 Nguyen et al. ..... 166/289
2004/0231846 A1 * 11/2004 Griffith et al. ..... 166/291
2005/0103527 A1 * 5/2005 Church et al. ..... 175/62
2005/0279509 A1 * 12/2005 Benzie et al. ..... 166/380

OTHER PUBLICATIONS

"RCT: Reverse Circulation Technology", Published Apr. 16, 2004, http://www.gandytec.com/pdfs/RCT.pdf.*

* cited by examiner

*Primary Examiner*—David J Bagnell
*Assistant Examiner*—Cathleen R Hutchins
(74) *Attorney, Agent, or Firm*—Bennett Jones LLP

(57) ABSTRACT

A cementing apparatus for use in cementing operations using concentric tubing or drill string such as concentric drill pipe, concentric coiled tubing, and the like is provided having an isolation cementing tool and a cementing flow control means. Concentric tubing or drill string adapted for use in cementing a well is further disclosed. A method for cementing a well using concentric tubing or drill string is also provided.

34 Claims, 15 Drawing Sheets

Section I - I'

WELL CEMENTING APPARATUS AND METHOD

CROSS-REFERENCE TO RELATED APPLICATIONS

This application is a continuation-in-part of U.S. patent application Ser. No. 11/308,263, filed Mar. 14, 2006, which is a non-provisional application of 60/594,130, filed Mar. 14, 2005. The disclosures of these prior applications are considered part of, and are incorporated by reference herein, the disclosure of this application.

FIELD OF THE INVENTION

The present invention relates to an apparatus and method for cementing individual and multi- zones in a vertical, directional or horizontal wellbore, using concentric tubing or drill pipe.

BACKGROUND OF THE INVENTION

Cementing is used in the oil and gas industry to seal off fluids and unconsolidated materials from entering the well bore, for packing off unwanted zones, as a loss circulation material and to abandon wells.

Current cementing technology requires a casing or liner to be placed in the well bore and a cement slurry is then pumped downhole and back up into the space or annulus between the casing or liner and the wall of the well bore. However, each succeeding casing or liner placed in the wellbore has an outside diameter significantly reduced in size when compared to the casing or liner previously installed. Thus, each time casing is run in a wellbore the diameter of the wellbore is reduced by the size of that casing.

Further, where operations require the cementing of casing such as the setting of surface or production casing, there is the need to use the following equipment: a casing shoe, float equipment and cement plug. This equipment can only be removed by drilling them out. This takes up valuable drilling time and can prove difficult when using a reverse circulation concentric drill string system.

The present invention allows the cementing operation to be completed without the need to run casing or have cement returned to surface thereby allowing larger diameter wellbores to be drilled into zones of interest. Further, time and money are saved on not having to run intermediate casing strings, and cement does not have to be pumped to surface. Finally, the present invention allows cementing to be completed without having to drill out equipment such as cement plugs, float equipment and casing shoes.

SUMMARY OF THE INVENTION

The present invention provides a cementing apparatus for use in cementing operations using concentric tubing or drill string such as concentric drill pipe, concentric coiled tubing, and the like, which concentric tubing or drill string is generally referred to herein as concentric drill string. Concentric drill string comprises an inner string having an inner conduit and an outer string forming an annular conduit therebetween. The present invention further provides a method for cementing a well using concentric tubing or drill string. Finally, the present invention provides concentric drill string modified for use in cementing a well.

Examples of cementing operations where the cementing apparatus, modified concentric drill string, and cementing method of the present invention can be used include:

cementing in a casing;

well abandonment;

cementing zones off without using casing;

repairing damaged underground aquifiers, which result from drilling and fractioning stimulation operations.

In one aspect of the invention, a cementing apparatus is provided comprising an isolation cementing tool and a cementing flow control means. In one embodiment, the isolation cementing tool has a center tube and an outer casing forming an annular conduit therebetween. The isolation cementing tool further has an expandable packer means surrounding at least partially the outer casing. The isolation cementing tool is adapted to connect to a bottom of a piece of concentric drill string in such a fashion as to be in fluid communication with the concentric drill string.

In one embodiment, the cementing flow control means also has a center tube and an outer casing forming an annular conduit therebetween and is either directly connected to the bottom of the isolation cementing tool or separated from the isolation cementing tool by additional pieces of concentric drill string of varying lengths such that the cementing flow control means is also is in fluid communication with both the isolation tool and the concentric drill string.

The cementing flow control means further has a means for stopping or regulating flow, positioned either in the annular conduit between the center tube and the outer casing or in the center tube, i.e., in the inner conduit, to prevent cement from flowing upwardly through the annular conduit and inner conduit when cement is being pumped down through the opposite conduit. Thus, during the cementing operation, the cementing flow control means operates to allow the flow of cement down through one conduit but not up through the other conduit by having the means for stopping or regulating flow, which is positioned in the other conduit, in the "closed position". On the other hand, when cementing is completed and it may be desirable to pump a fluid such as water, air, gas, etc., down through the closed or sealed conduit, as will be described in more detail below, the means for stopping or regulating flow is now placed in the "open position" to allow the fluid to be delivered therethrough.

Means for stopping or regulating flow may comprise a single valve operable to open and close with or without actuating means, multiple valves, at least one non-valved flow divider, or at least one other flow restrictor known in the art. In one embodiment, the means for stopping or regulating flow comprises at least one check valve located in either the annular conduit or the inner conduit. It is understood that check valves are generally mechanical valves that permit gases and liquids to flow in only one direction, thereby preventing process flow from reversing. They are often classified as one-way directional valves. Fluid flow in the desired direction opens the valve, while backflow forces the valve closed.

The mechanics of check valve operation are not complicated. For example, many check valves contain a ball that sits freely above the seat, which has only one through hole. The ball has a slightly larger diameter than that of the through hole. When the pressure behind the seat exceeds that above the ball, liquid is allowed to flow through the valve. But once the pressure above the ball exceeds the pressure below the seat, the ball returns to rest in the seat, forming a seal that prevents backflow.

It is understood, however, that check valves use a variety of technologies to allow and stem the flow of liquids and gases. Some of these technologies are as follows: single disc swing valves, double disc swing valves, lift-check, silent, ball-check and cone-check.

Single disc swing valves are designed with the closure element attached such that the closure element can be pushed aside by the flow, but swings back into the close position upon flow reversal. Double disc or wafer check valves consist of two half-circle disks hinged together that fold together upon positive flow and retract to a full-circle to close against reverse flow. The valve may be inserted between two flanges.

Double disc swing valves are useful when means for stopping or regulating flow is located in the annular conduit. In this embodiment, it is understood that the two half-circle disks will be C-shaped to allow each half-circle to enclose half of the annular conduit. When each half-circle disc is in the closed position, it is understood that the entire annual conduit is now sealed and the flow of any fluid therethrough is stopped.

It is understood that the means for stopping or regulating flow may comprise other types of valves which open and close using various actuating means rather than mechanically opening and closing as a result of fluid flow. It is also understood that the means for stopping or regulating flow may comprise other non-valved flow dividers or flow restrictors known in the art.

In one embodiment of the cementing flow control means where the means for stopping or regulating flow is located in the annular conduit of the cementing flow control means, which embodiment is used when cement is pumped through the inner conduits, the inner diameter of the center tube of the cementing flow control means is reduced at or near the bottom end thereof to prevent a cement plug from exiting therefrom, as will be explained in more detail below. In another embodiment of the cementing flow control means where the means for stopping or regulating flow is located in the inner conduit of the cementing flow control means, which embodiment is used when cement is pumped through the outer conduits, the inner diameter of the outer casing of the cementing flow control means is reduced at or near the bottom end thereof to prevent a donut-shaped cement plug from exiting therefrom.

In operation, when the packer means of the isolation cementing tool is in the expanded position, the isolation cementing tool is in the "closed position" and when the packer means is in the contracted position the isolation cementing tool is in the "open position". When in the contracted or open position, fluids are free to flow through the outer annulus between the concentric drill string and the formation walls. In a preferred embodiment, the expansion of the packer means is controlled by an electric current for quicker opening and closing of the isolation cementing tool, however, other means for expanding and contracting a packer known in the art can also be used.

When running the cementing apparatus in the hole, the isolation cementing tool is in the open position, i.e., the packer means is contracted. When the tool is in the open position it does not restrict or reduce the radius of the annulus between the outside wall of the drill string and the wellbore, as the outside diameter of the tool is preferably equal to, less than or slightly larger than the outside diameter of the concentric drill string.

When cementing is required, the isolation cementing tool, which is now positioned directly above the zone to be cemented, is put in the closed position, i.e., the packer means is expanded to abut the adjacent wellbore walls. Thus, the portion of the well bore below the isolation cementing tool is shut off or isolated from the portion of the well bore above the tool as the expanded packer means will not allow fluids to flow passed it.

According to another aspect of the invention, there is provided a system for cementing a zone in a wellbore, comprising:

an open hole annular expandable packer means;

a concentric drill string having a top and bottom comprising an inner string having an inner conduit and situated within an outer string to form an annular conduit therebetween, said concentric drill string having an outside diameter such that it can be snugly inserted through the center of the annular expandable packer means; and a means for stopping or regulating flow positioned at or near the bottom of the concentric drill string in either the annular conduit or the inner conduit.

Any number of annular expandable packer means known in the art can be used, for example, a TAM International inflatable Casing Annulus Packers (CAP™). Other examples of packer means useful in the present invention can be found in U.S. Pat. No. 5,743,335 and U.S. Pat. No. 6,988,557, incorporated herein by reference. Further, any number of means for stopping or regulating flow known in the art can be used, as described above. In a preferred embodiment, one of the inner string and outer string has a reduced internal diameter at or near the bottom thereof to prevent a cementing plug from exiting the concentric drill string.

According to another aspect of the present invention, the concentric drill string itself can be modified for use in cementing operations of the present invention. Hence, concentric drill string having an inner string with an inner conduit and situated within an outer string to form an annular conduit therebetween is provided for use in cementing a zone in a wellbore, the concentric drill string comprising:

an expandable packer means surrounding the outer string at or near a bottom end of the concentric drill string; and a means for stopping or regulating flow positioned at or near the bottom of the concentric drill string in either the annular conduit or the inner conduit.

According to another aspect of the invention, there is provided a method for cementing a zone in a wellbore formation with cement, comprising:

providing a concentric drill string comprising an inner string having an inner conduit and situated within an outer string to form an annular conduit therebetween;

pumping cement down one of the inner or annular conduits of the concentric drill string to the zone to be cemented sealing off an outside annulus formed between a wall of the wellbore and an outer surface of the concentric drill string at a position above the zone to prevent the flow of cement therethrough from the zone; and sealing off the other of the inner or annular conduits of the concentric drill string to prevent the flow of cement therethrough from the zone.

A further embodiment of the method comprises adding a cementing plug to the unsealed conduit after all the cement has been pumped therethrough and then pumping a first fluid through the unsealed conduit after the addition of the cementing plug to assist in pushing the cement through the unsealed conduit and into the zone in the wellbore formation. In a preferred embodiment, the cementing plug is prevented from exiting into the wellbore.

A further embodiment of the method comprises opening the sealed conduit and pumping a second fluid therethrough such that the second fluid is reverse circulated back up the unsealed conduit thereby removing the cementing plug and first fluid from the unsealed conduit to the surface of the wellbore.

A further embodiment of the method comprises opening the sealed conduit and adding curing agents therethrough.

Curing agents include various chemicals and other additives known in the art for curing cement as well as a variety of gases such as air, nitrogen and carbon dioxide that are also used in the industry for curing cement.

In one embodiment of the method, a cementing apparatus of the present invention comprising an isolation cementing tool and a cementing flow control means can used. The cementing apparatus is placed at or near the bottom of concentric tubing or drill pipe and lowered into the wellbore until the isolation tool is slightly above the zone to be cemented. When the cementing process commences, or shortly thereafter, the isolation cementing tool is put in the closed position, meaning that the packer means is expanded to prevent the flow of cement back to the surface between the outer annulus between the concentric tubing or drill pipe and the wellbore.

By way of example, cement is pumped down the inner string of the concentric drill string, through the center tube of the isolation cementing tool and ultimately through the center tube of the cementing flow control means and into the formation. A cement plug of a type well known in the art is then inserted into the inner string and "chased" with a first fluid such as water, gas, air, etc., which first fluid is also pumped through the inner string, etc.

The insertion of the cement plug and the subsequent pumping of first fluid force the cement out through the bottom of the cementing flow control means and into the formation. In this embodiment, it is desirable to prevent the flow of cement back up through the annular conduit of the concentric tubing or drill pipe to the surface so the cementing flow control means has a means for stopping or regulating flow located in the annular conduit thereof. For example, when the means for stopping or regulating flow comprises at least one check valve of a kind described above, the upward pressure exerted on the check valve, which upward pressure results from the pumping of the cement through the inner conduit, will cause the check valve to be in the closed position, thereby preventing the cement from flowing through the annular conduit to the surface of the wellbore. Thus, cement is prevented from flowing up the annular conduit of the concentric drill string as a result of the upward pressure exerted on the check valve in the annular conduit of the cementing flow control means, closing same.

The cement plug, which preferably has a diameter slightly less than the inner diameter of the center tube of the cementing flow control means, will ultimately hit the portion of the center tube of the cementing flow control means where the inner diameter of the center tube is reduced. The plug becomes wedged at that point such that no further fluid can be pumped therethrough. The first fluid contained in the inner conduit of the inner string of the concentric drill string can then be easily removed by reverse circulating a second fluid such as water, air, gas and the like through the annular conduit of the concentric drill string thereby forcing the plug to be dislodged and travel up the inner conduit of the inner string of the concentric drill string to the surface. Further, any first fluid present in the inner string will also be forced up to the surface.

In another embodiment of the method, an open hole annular expandable packer means known in the art can be used. The annular expandable packer means is first positioned in the open hole directly above the zone to be cemented and then expanded to be in tight engagement with the wellbore wall. Concentric drill string is then inserted into the center of the expandable packer means and is also in relatively tight engagement with the expandable packer means. In this embodiment, concentric drill string further comprises a means for stopping or regulating flow positioned at or near its bottom in either the annular conduit or the inner conduit to prevent the flow of cement therethrough from the zone.

The invention has one or more of the following advantages over current cementing methods:

Cementing back to surface isn't required;

Less damage to producing formations from the lower hydrostatic cement weight;

Less cement in the formation for fracture treatment to deal with;

No need to run a string of casing, cementing shoe and float equipment

Much less cement is needed;

The main portion of the well can be drilled with the same hole diameter;

Chemicals to strength and accelerate the curing of the cement can be added through the concentric drill string, preferably through the annular conduit;

Loss circulation material can be added through the concentric drill string, preferably through the annular conduit;

Single or multiple zones can be cemented off to prevent fluid invasion or unconsolidated materials from plugging the well bore;

Significant cost savings on cementing time, actual cement and casing costs;

When water is used as the "chasing" fluid, water is conserved by collecting it through the concentric drill string, preferably out through the inner string, to the surface prior to removing the concentric drill string;

Lower productive zones can be completed with larger diameter casing, liners or left open hole;

Compressed air can be blown down the concentric drill string, either through the annular conduit or through the inner string to greatly reduce the curing time of the cement;

No casing shoe, float equipment and cement plug to drill out; and

Well abandonment programs can be done much quicker and cheaper;

DETAILED DESCRIPTION

The cementing apparatus and method will be described with reference to the following preferred embodiments.

Figure 1:
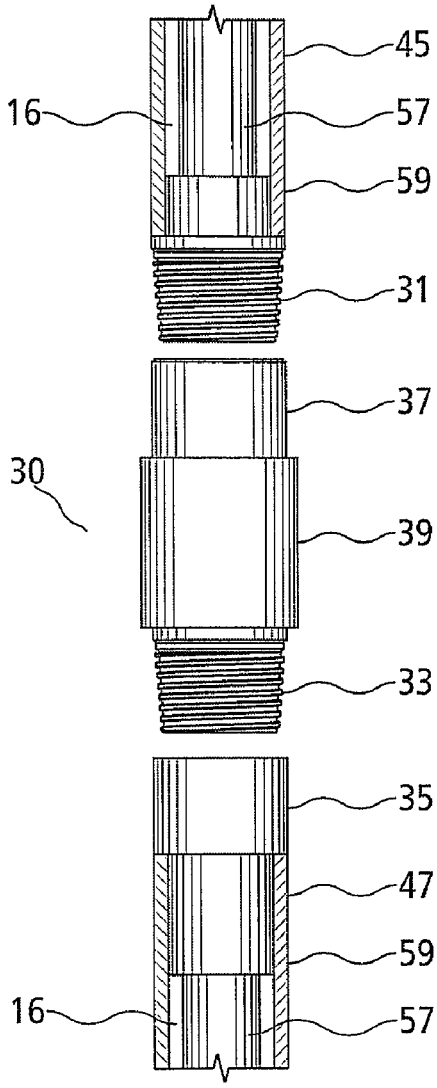
FIG. 1 is a schematic of an embodiment of an isolation cementing tool of the present invention.

FIG. 1 schematically illustrates an embodiment of an isolation cementing tool 30 and means for attaching the tool between two pieces of concentric drill string 45 and 47. Preferably, isolation cementing tool 30 is attached to concentric drill string 45 and 47 such that the isolation cementing tool 30 is position the proper distance from the bottom of the wellbore to allow the desired zone to be properly cemented.

Concentric drill string 45 and 47 both comprise an inner string 57 and an outer string 59, forming an annular conduit 16 therebetween. Concentric drill string 45 and 47 are designed such that at one end of the concentric drill string is a threaded pin end and at the other is a threaded box end. Thus, pieces of the concentric drill string can be connected end to end by screwing the thread pin end of the new piece of concentric drill string to be added into the box end of the drill string below. It is understood that concentric drill string could also be a continuous length of concentric coiled tubing having an inner coiled tube and an outer coiled tube in which case isolation cementing tool would be operably attached to the end thereof by coupling means known in the art for coupling downhole tools to coiled tubing.

As can be seen in FIG. 1, concentric drill string 45 has threaded pin end 31 at its bottom end and concentric drill string 47 has threaded box end 35 at its top end. Isolation cementing tool 30 is adapted to be inserted between concentric drill string 45 and 47 by means of threaded box end 37 and threaded pin end 33. Thus, threaded pin end 31 of concentric drill string 45 screws into threaded box end 37 and threaded pin end 33 screws into threaded box end 35 of concentric drill string 47. It is anticipated that in some instances concentric drill string 47 may only be a short piece of concentric drill string, e.g., it may not be a complete length of concentric drill pipe as is known in the art. Isolation cementing tool 30 further comprises a packer means 39 surrounding the isolation cementing tool, the operation of which will be described in more detail below.

Figure 2:
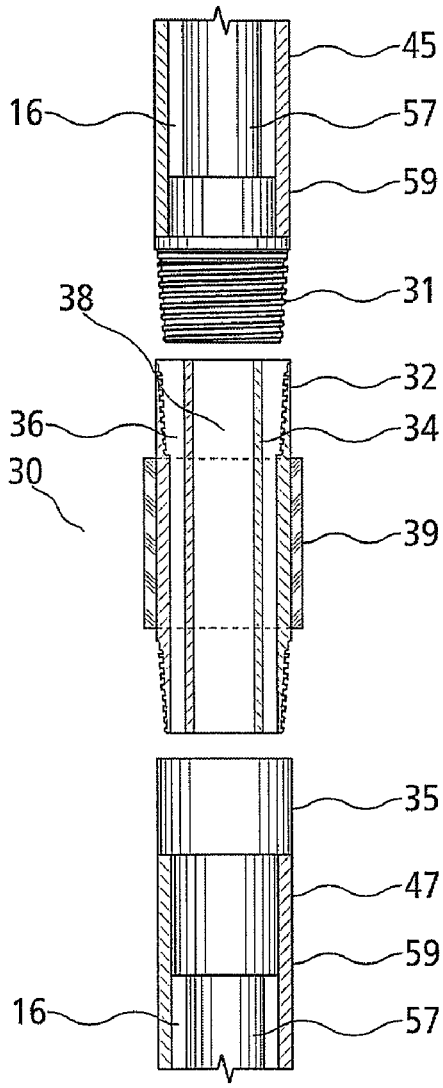
FIG. 2 is a vertical sectional view on and enlarged scale of the isolation cementing tool shown in FIG. 1.

With reference to FIG. 2, isolation cementing tool 30 further comprises a center tube 34, an outer casing 32, an annular conduit 36 between the center tube and outer casing, an inner conduit 38, and a packer means 39 surrounding said outer casing 32. When isolation cementing tool 30 is inserted between concentric drill string 45 and 47, the center tube 34 of the isolation cementing tool 30 is in fluid communication, i.e., via inner conduit 38, with the inner string 57 of the concentric drill string 45 and 47 and the annular conduit 36 of the isolation cementing tool 30 is in fluid communication with the annular conduit 16 of the concentric drill string 45 and 47.

In one embodiment, packer means 39 can be expanded or contracted by means of an electric current flow path. In another embodiment, the packer means comprises an inflatable ring, which can be inflated by pumping various types of fluid into and out of the ring, as is known in the art.

Figure 3A:
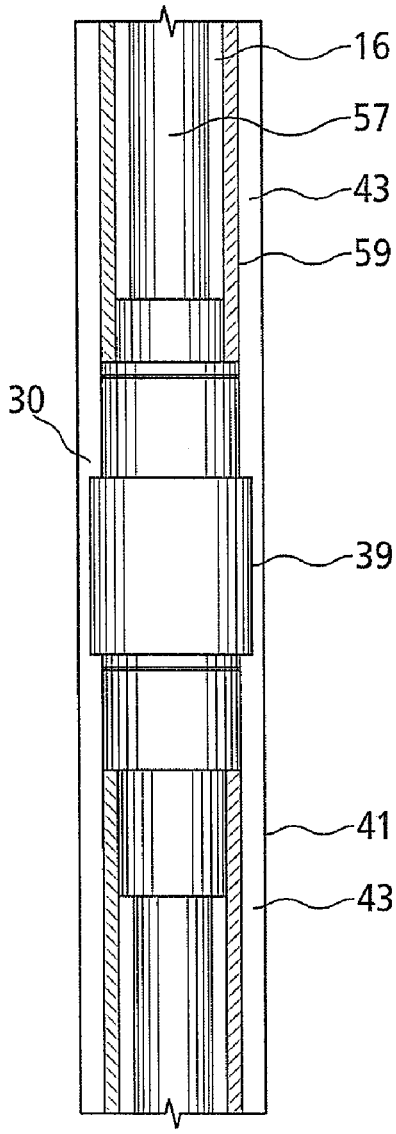
FIGS. 3*a* and 3*b* is a schematic of the isolation cementing tool of FIG. 1 in the open position and closed position, respectively.
Figure 3B:
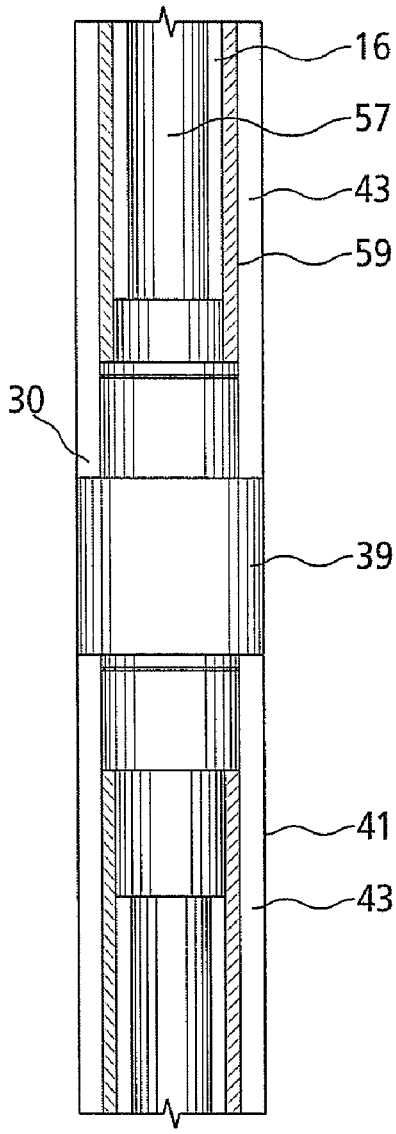

FIGS. 3*a* and 3*b* schematically illustrate the isolation cementing tool attached to the concentric drill string in the open and closed position, respectively, during cementing operations. When packer means 39 is contracted or deflated as shown in FIG. 3*a*, the tool is in the open position and fluids can flow freely through the wellbore annulus 43 formed between the outer wall of the outer string 59 of the concentric drill string and formation wall 41. When packer means 39 is expanded or inflated as shown in FIG. 3*b*, the packer means is forced against formation wall 41 thereby closing off annulus 43 to fluid movement above and below packer means 39.

Figure 4A:
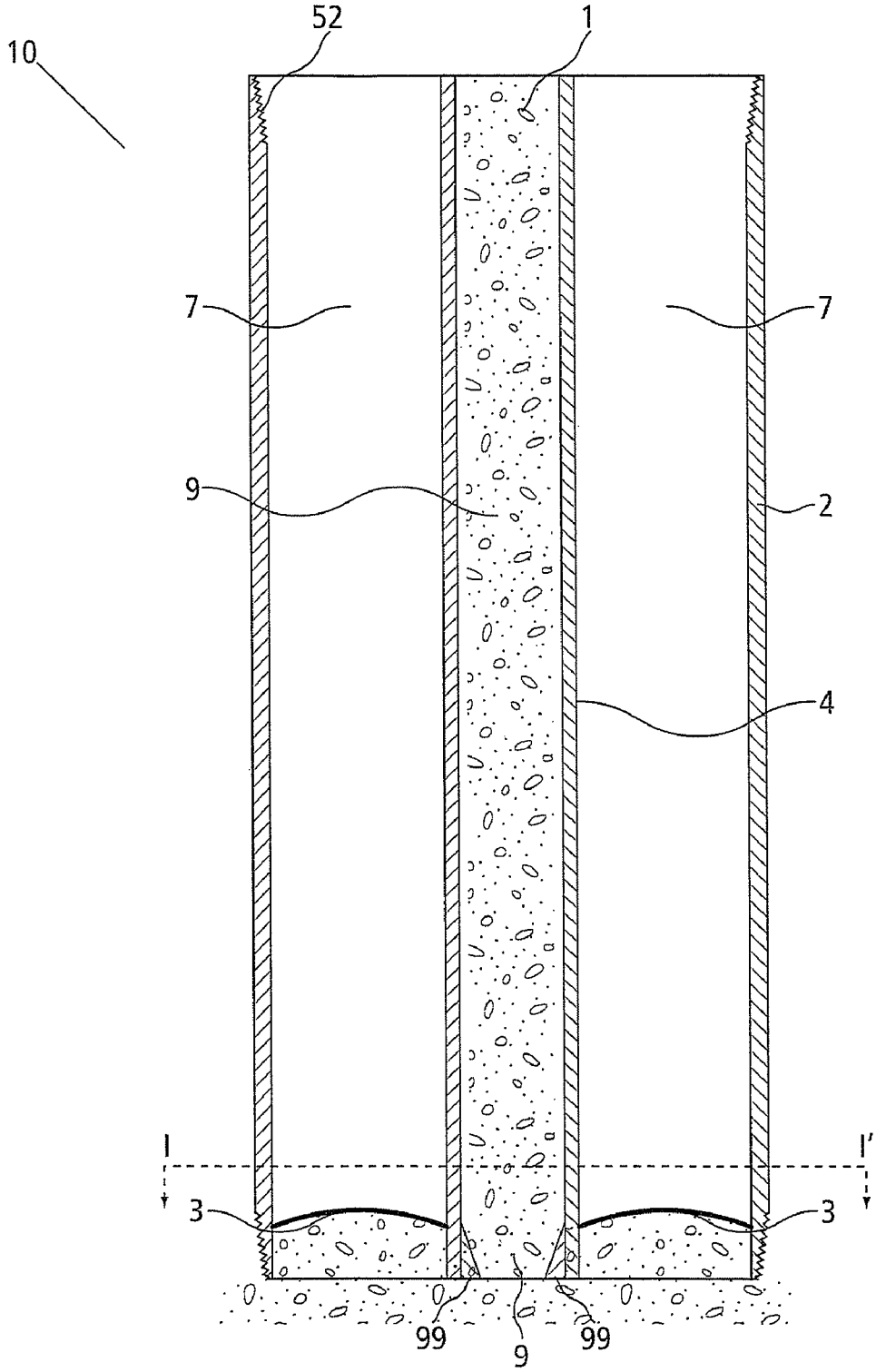
FIG. 4*a* is a vertical sectional view of an embodiment of a cementing flow control means with cement flowing down the center tube and means for stopping or regulating flow comprising a check valve in the closed position.

FIG. 4*a* is a vertical sectional view of one embodiment of a cementing flow control means 10, which forms part of the cementing apparatus of the invention. Cementing flow control means 10 comprises a center tube 4 and an outer casing 2, forming an annular conduit 7 therebetween. Cementing flow control means further has a means for stopping or regulating flow comprising a check valve 3 which is shown situated within the annular conduit 7 in this particular embodiment. It is understood that in an embodiment where it is desirable that cement is pumped down the annular conduit of the concentric drill sting, cementing flow control means would comprise a means for stopping or regulating flow in the inner conduit 1 of the center tube 4. For example, in this embodiment, means for stopping or regulating flow may comprise a ball-type check valve or a single disc swing valve. Check valves useful in downhole tools are well known in the art to allow fluid or gas to flow through tools in only one direction.

It can be seen in FIG. 4*a* that the inner diameter of the center tube 4 is reduced at the bottom end thereof. Thus, the inner wall diameter at the bottom end is less than the diameter of the rest of the center tube 4. This area of reduced diameter is often referred to in the art as a stinger and is designated element 99. FIG. 4*a* shows cement 9 being pumped through the inner conduit 1 of center tube 4. Annular conduit 7 is closed off at the bottom of the cementing flow control means by check valve 3 being in the closed position, thereby preventing cement 9 from flowing up annular conduit 7. Cementing flow control means 10 further comprises threaded box end 52 so that this end can be attached to either the threaded pin end of a piece of concentric drill string or directly attached to the threaded pin end 33 of isolation cementing tool.

When the cementing flow control means 10 is properly connected, it is understood that center tube 4 of the cementing flow control means 10 is in fluid communication with the inner string of concentric drill string and the center tube of the isolation cementing tool, and that annular conduit 7 of the cementing flow control means 10 is in fluid communication with the annular conduit of concentric drill string and the annular conduit of the isolation cementing tool.

Figure 4B:
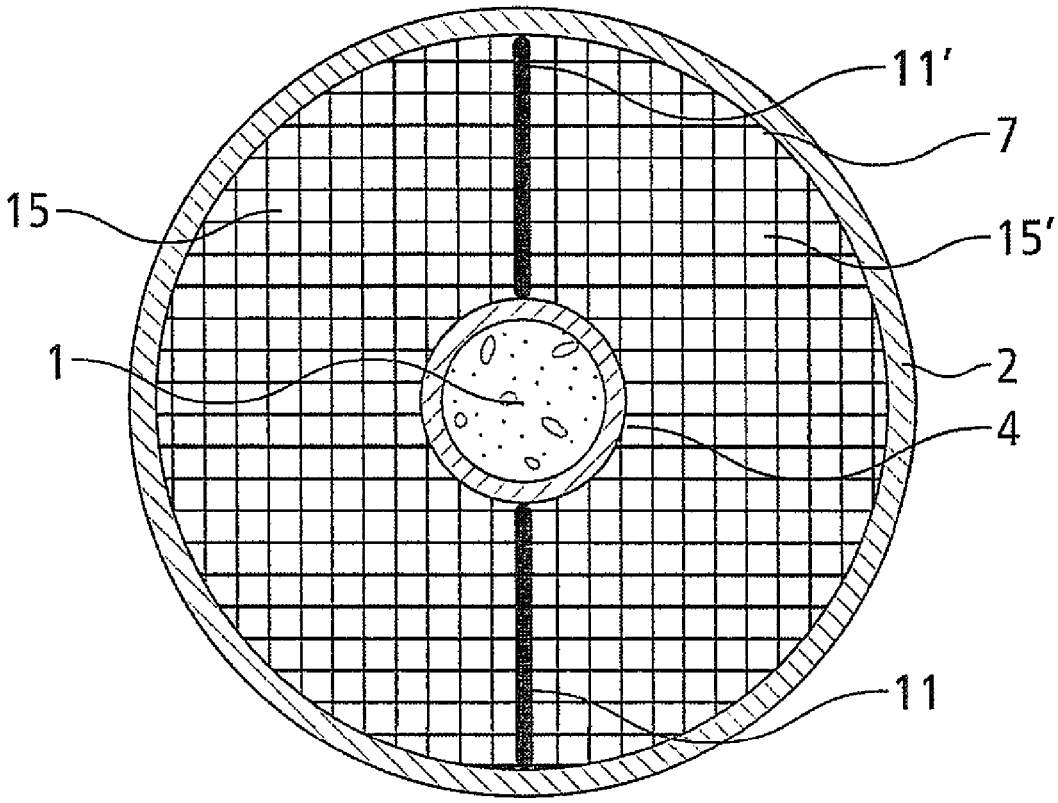
FIG. 4*b* is a cross-sectional view of the cementing flow control means of FIG. 4*a* taken along line I-I showing check valve in the closed position.

FIG. 4*b* is a cross-sectional view of the cementing flow control means of FIG. 4*a* where check valve 3 is in the closed position and therefore closing or sealing off the entire annular conduit 7. In this embodiment, check valve 3 comprises two C-shaped half-circle disks 15 and 15' held together by hinges 11 and 11' such that the half-circle disks fold together upon positive flow (i.e., when pumping a second fluid down the annular conduits) and retract to a full-circle to close against reverse flow when no fluid is being pumped down the annulus (i.e., during the pumping of cement through the inner conduits).

Figure 4C:
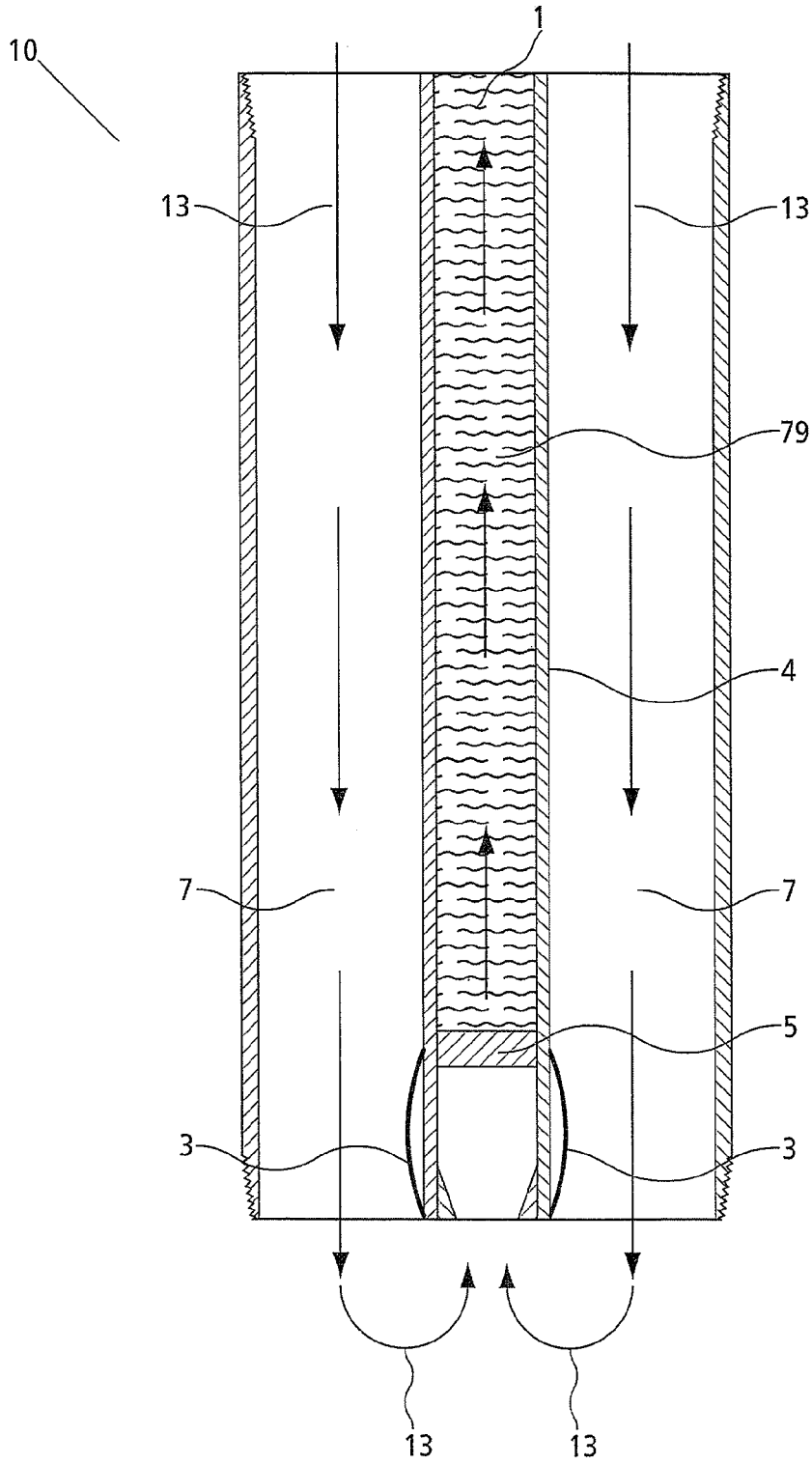
FIG. 4*c* is a vertical sectional view of the cementing flow control means of FIG. 4*a*, in the displacement position, showing check valve in the open position and compressed fluid being delivered down the annular conduit for pushing the cement plug and water up the center tube to the surface.

FIG. 4*c* is a vertical sectional view of cementing flow control means 10 during the displacement/removal of fluid 79 operation. Here, a first fluid 79 such as water has already been pumped through the inner conduit 1 to chase cement plug 5 to the bottom of the cementing flow control means, thereby forcing essentially all of the cement into the formation. During the displacement operation, a second fluid 13 such as compressed air is pumped down the various annular conduits and reverse circulated up through the various inner conduits. The second fluid 13 displaces both cement plug 5 and fluid 79, which are both eventually forced to the surface of the wellbore where each can be collected. Fluid 79 can be reused in the cementing process, which is particularly useful when fluids such as water are only available in scarce quantities.

When the pressure of the second fluid 13 such as compressed air is exerted on check valve 3, the check valve is forced in the open position, i.e., the two half-circle disks fold towards one another thereby allowing for the passage of second fluid 13 through the annular conduit 7 and up through inner conduit 1, as shown by the arrows in FIG. 4*c*. Thus, air 13 eventually displaces both cement plug 5 and fluid 79 up through the center (inner conduit) of the concentric drill string to the surface. This both eliminates the necessity to drill out the cement plug and conserves fluids such as water.

Once cementing is completed and the cement plug and excess water removed, isolation cementing tool 30 is placed back in the open position, i.e., packer means is deflated as shown in FIG. 2, and the concentric drill string is tripped out of the well bore. In a preferred embodiment, isolation cementing tool 30 is put in the open position and concentric drill string 47 is pulled up above the cement in the well bore. Isolation cementing tool 30 is then placed in the closed position and compressed air or other gas is pumped down annular conduits 16, 36 and 7 to reduce the amount of time for the cement to cure so drilling or other operations may resume.

Figure 5A:
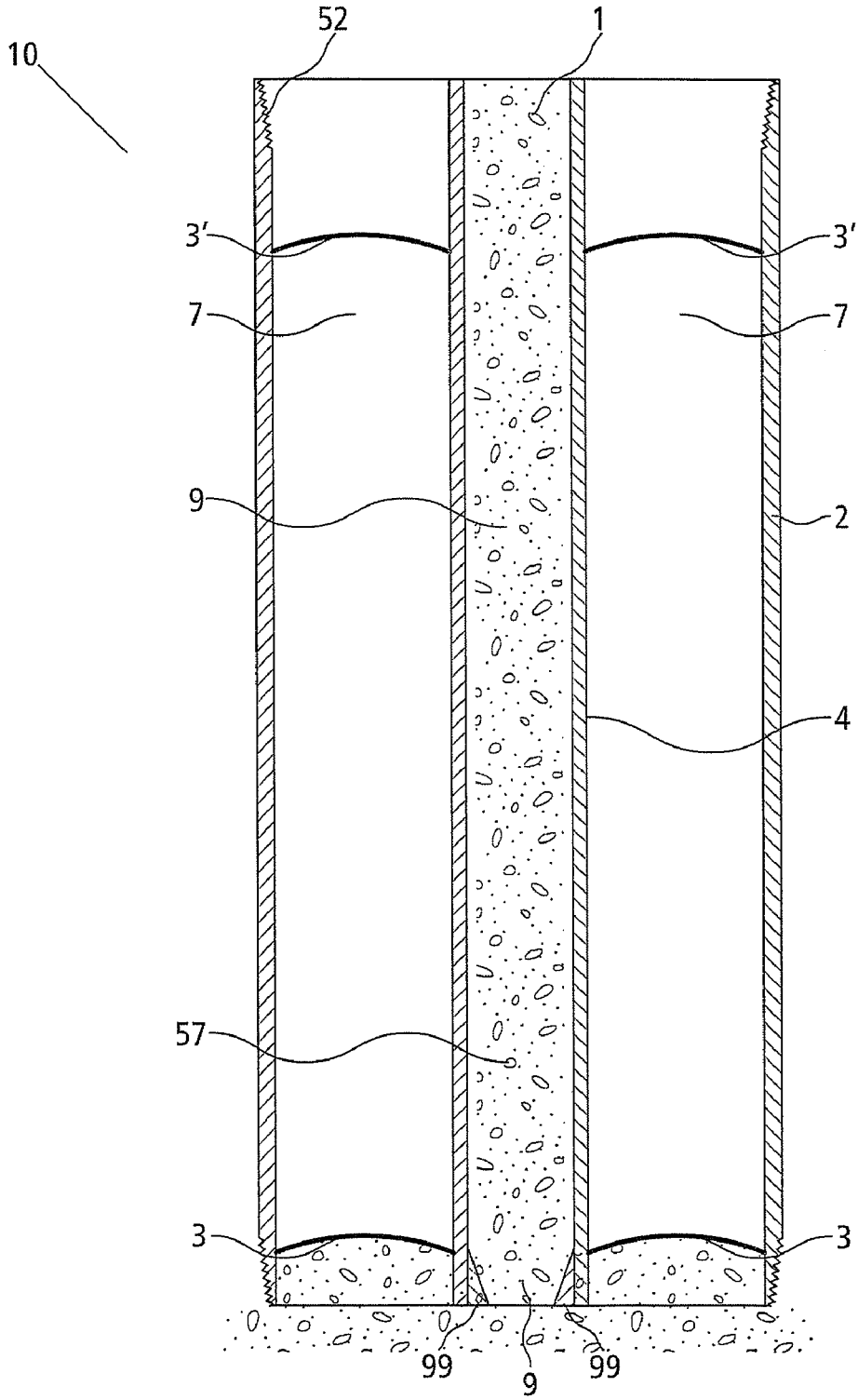
FIG. 5*a* is a vertical sectional view of another embodiment of a cementing flow control means with cement flowing down the center tube and means for stopping or regulating flow comprising two check valves in the closed position.

FIG. 5*a* is a vertical sectional view of another embodiment of a cementing flow control means 10, which forms part of the cementing apparatus of the invention. In this embodiment, cementing flow control means 10 comprises a means for stopping or regulating flow, which flow means comprises more than one check valve. Check valve 3 is positioned near the bottom of the cementing flow control means and check valve 3' is located near the top of cementing flow control means 10. Having a means for stopping or regulating flow comprising a plurality of check valves ensures that if one check valve fails, there are other check valves operable to prevent the flow of cement therethrough to the surface of the wellbore.

Figure 5B:
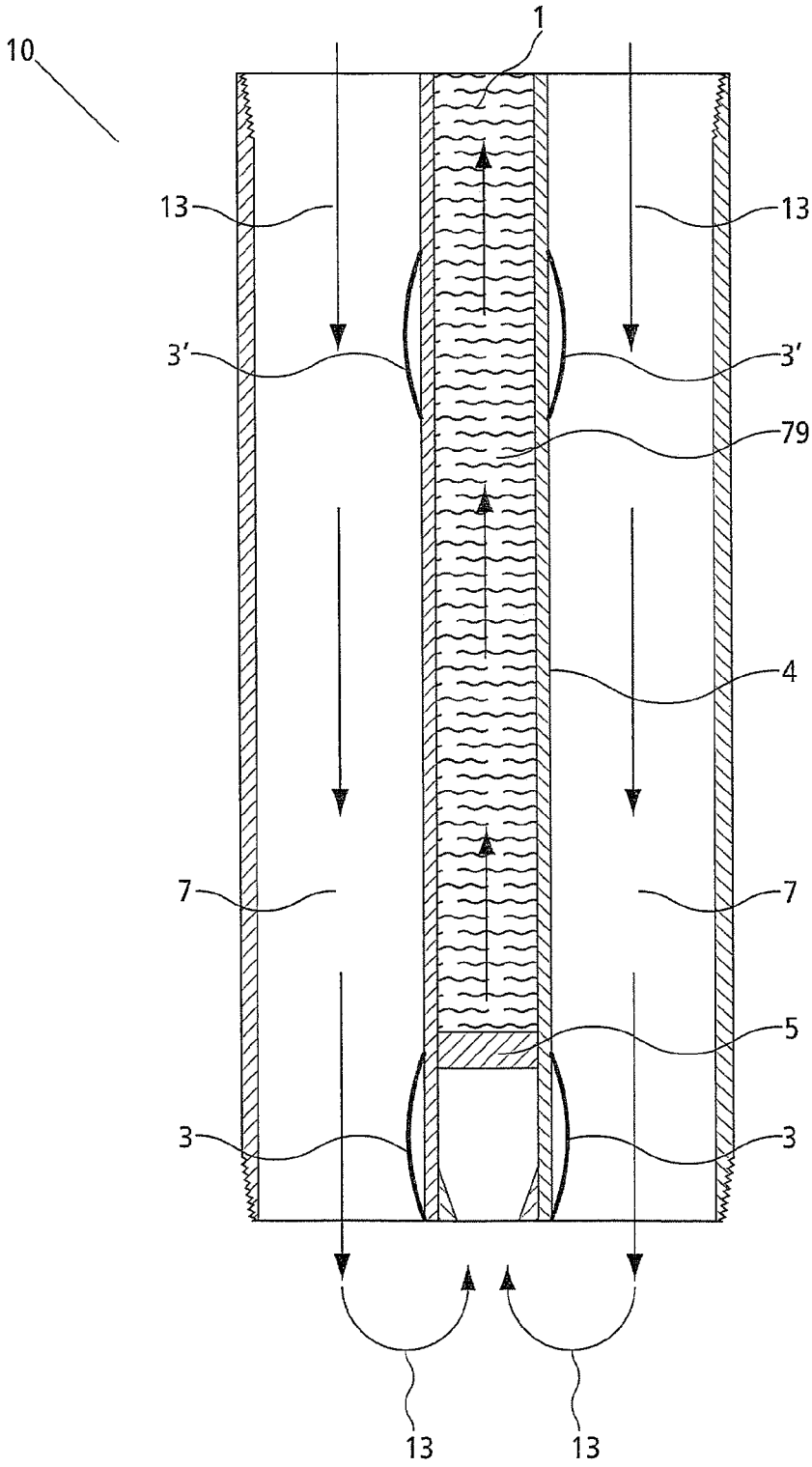
FIG. 5*b* is a vertical sectional view of the cementing flow control means of FIG. 5*a*, in the displacement position, showing the two check valves in the open position and compressed fluid being delivered down the annular conduit for pushing the cement plug and water up the center tube to the surface.
Figure 5C:
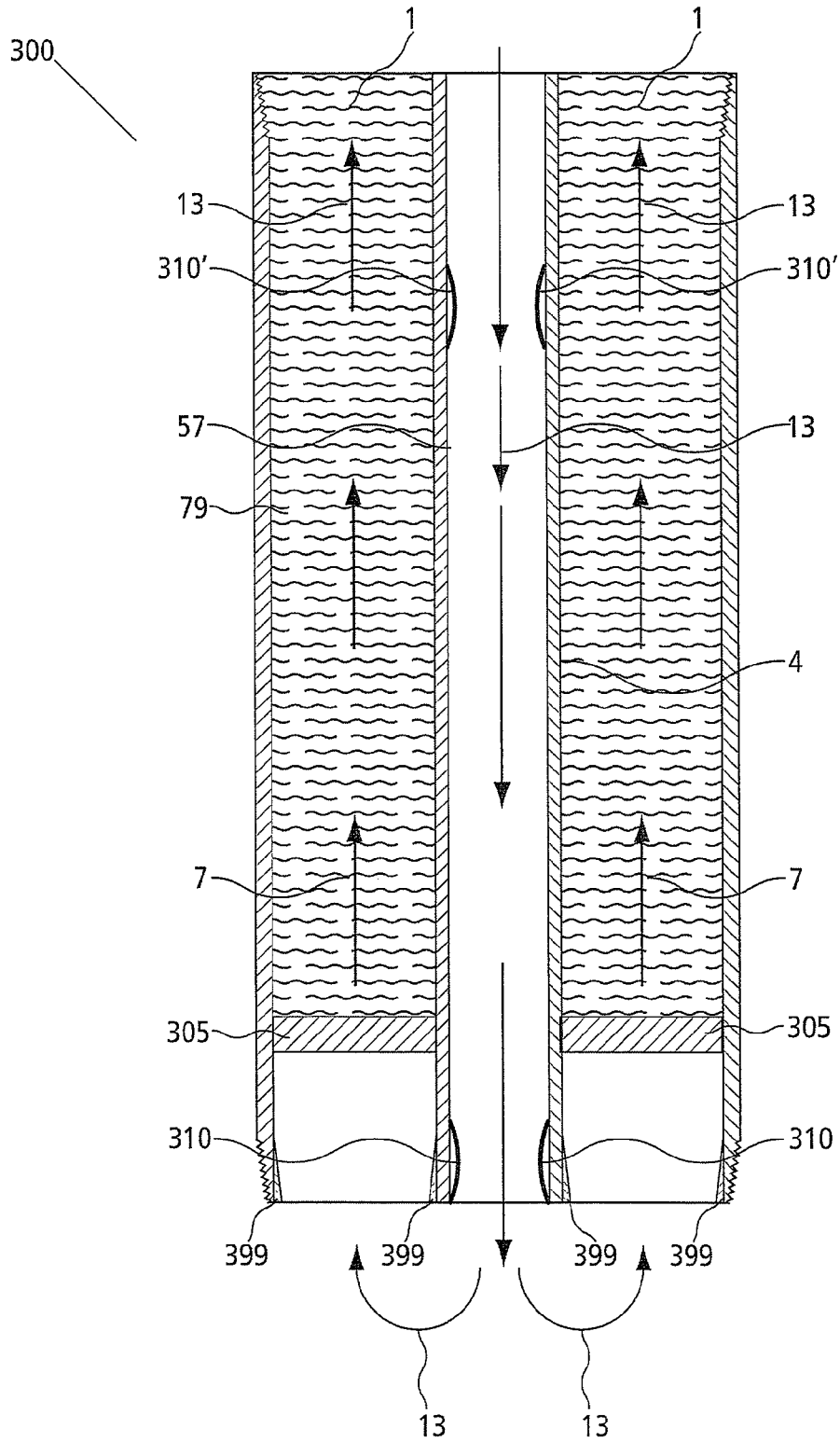
FIG. 5*c* is a vertical cross sectional view of another embodiment of a cementing flow control device comprising two check valves in the open position located in the inner conduit of the device.

FIG. 5*b* is a vertical sectional view of the cementing flow control means 10 of FIG. 5*a* during the displacement operation as described above. FIG. 5*b* shows both check valve 3' and check valve 3 in the open position as a result of the flow of a second fluid 13 such as compressed air through the annular conduit 7.

Figure 6:
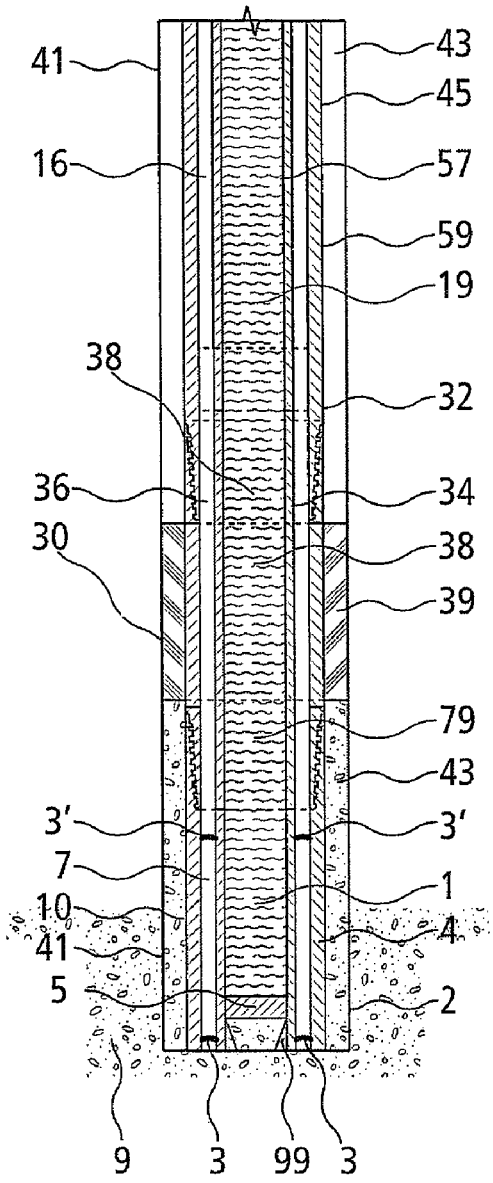
FIG. 6 is a vertical sectional view of an embodiment of a cementing apparatus of the invention assembled on concentric drill string.

FIG. 6 illustrates an embodiment of an assembled cementing apparatus of the present invention. Isolation cementing tool 30 is shown operably attached to concentric drill string 45 by means of threads as described above. It can be seen that annular conduit 16 of concentric drill string 45 is in fluid communication with annular conduit 36 of isolation cementing tool 30 and that inner conduit 19 of concentric drill string 45 is in fluid communication with inner conduit 38 of isolation cementing tool 30. In this embodiment, cementing flow control means 10 is directly attached to the end of isolation cementing tool 30 by thread means. It can be seen that annular conduit 7 of cementing flow control means 10 is in fluid communication with annular conduit 36 of the isolation cementing tool 30 and that inner conduit 1 of cementing flow control means 10 is in fluid communication with inner conduit 38 of isolation cementing tool 30.

In operation, in one embodiment of the invention, cement 9 is first pumped through inner conduit 19 of inner string 57, then through inner conduit 38 of isolation cementing tool 30, and finally through inner conduit 1 of cementing flow control means 10. Isolation cementing tool is in the closed position. Cement plug 5, which has on outside diameter slightly smaller than the inner diameter of the inner string 57, the inner diameter of center tube 34 and the largest inner diameter of center tube 4, but larger than the diameter of stinger 99, is inserted through inner string 57 and "chased" with a first fluid such as air, gas or water 79.

The pumping pressure of first fluid 79 pushes cement plug 5 down to the bottom of the cementing flow control means 10 and thereby forces cement 9 out into the wellbore. The pressure ultimately forces cement 9 past formation wall 41 and into the formation itself causing that part of the formation to become sealed off. Some of the cement 9 will be forced up outer annulus 43 but flow will be stopped when cement 9 reaches the bottom of inflated/expanded packer means 39 (the closed position). Cement 9 is further prevented from returning up annular conduit 7, and subsequently up annular conduit 16 of concentric drill string 45 to the surface, by means of check valves 3 and 3' sealing off the annular conduit 7 as a result of the upward pressure which results when pumping down cement 9 and fluid 79 through the various inner conduits. In the alternative, check valves 3 and 3' could be placed in the closed position prior to the commencement of cementing by an actuating means known in the art.

Cement plug 5, which follows cement 9, is eventually chased down by first fluid 79 to the bottom of cementing flow control means 10. As previously mentioned, the inner diameter of center tube 4 is reduced near its bottom forming stinger 99 so that travel of cement plug 5 is stopped. At this point, essentially all of the cement 9 will have been forced out of the various inner conduits and into the formation, leaving most of first fluid 79 still contained in the inner conduit of inner string 57 of the concentric drill string 45.

At this point, chemicals or other additives to strengthen or speed up the cure time for the cement 9 can be pumped down annular conduit 16 by applying downward pressure to both check valve 3' and check valve 3 thereby opening them to allow the chemicals or additives to reach the cement 9. Also, a drying gas such as air, nitrogen, carbon dioxide, etc., can be pumped down annular conduit 16 to speed up the cement curing process. In some circumstances it may be desirable to raise the cementing apparatus above the newly deposited cement to allow enough room to deliver the air, nitrogen, carbon dioxide, etc. for curing the cement. Thus, packer means 39 will need to be contracted, i.e., put in the open position, the apparatus moved up hole, and then packer means 39 reset, i.e. expanded again to the closed position. Curing gas is then delivered through the annular conduit in this embodiment.

Further, first fluid 79, which has essentially been contained in the various inner conduits, can now be removed by reverse circulating a second fluid such as air or other fluid down annular conduit 16 of concentric drill string 45, through the annular conduit 36 of isolation cementing tool 30 and through annular conduit 7 of cementing flow control means 10 and up through the center of the center tube 4 of cementing flow control means 10, the center tube 34 of the isolation cementing tool 30 and the inner string 57 of concentric drill spring 45, thereby forcing out the first fluid 79 which can then be collected at the surface of the well.

Figure 7:
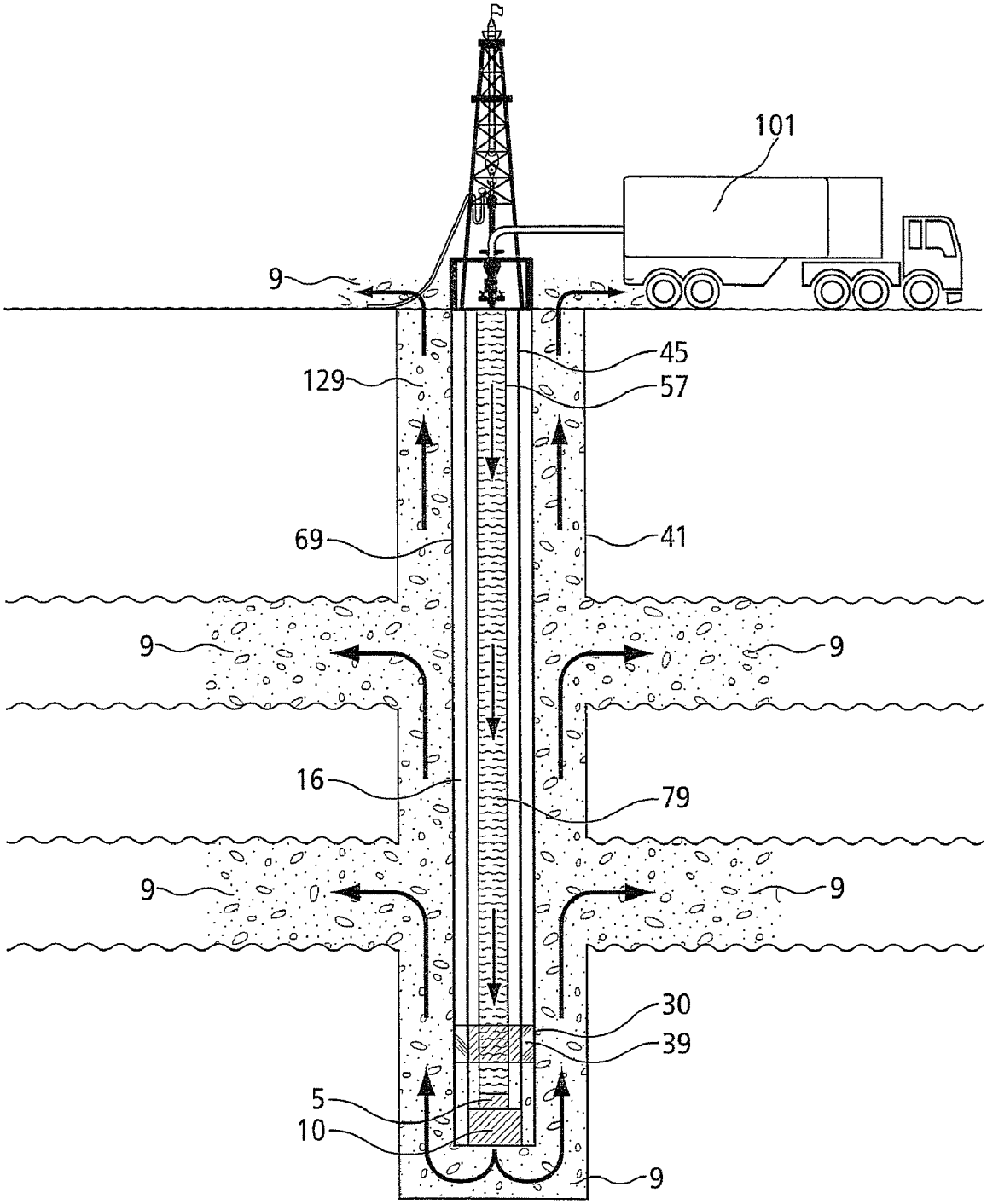
FIG. 7 is a schematic of the surface and downhole equipment involved in cementing a wellbore where casing has been run in the wellbore.

FIG. 7 illustrates another embodiment of the invention wherein casing is first placed in the wellbore. FIG. 7 shows the surface equipment required to pump cement down a well bore. Casing 69 is run in the wellbore between formation walls 41, thereby forming annulus 129 between the casing 69 and formation wall 41. Cement 9 is pumped from surface by cement pump 101 down inner tube 57 of concentric drill string 45, followed by cement plug 5 and fluid 79. Isolation cementing tool 30 is in the closed position, i.e., packer means 39 is in the expanded position and abuts against the inside wall of casing 69. When isolation cementing tool 30 is in the closed position, this allows both the pumping pressure and the hydrostatic weight of the cement 9 and fluid 79 to push cement 9 up annulus 129 to the surface of the wellbore. As previously explained, cementing flow control means 10 prevents cement 9 from entering annular conduit 16 of the concentric drill string 45.

Once the cement 9 returns to surface, displacement operations as shown in FIGS. 4*c* and 5*b* and described above commence. Thus, no casing shoe, float equipment and cement plug are left in the well bore that have to be drilled out when drilling operations resume.

Figure 8:
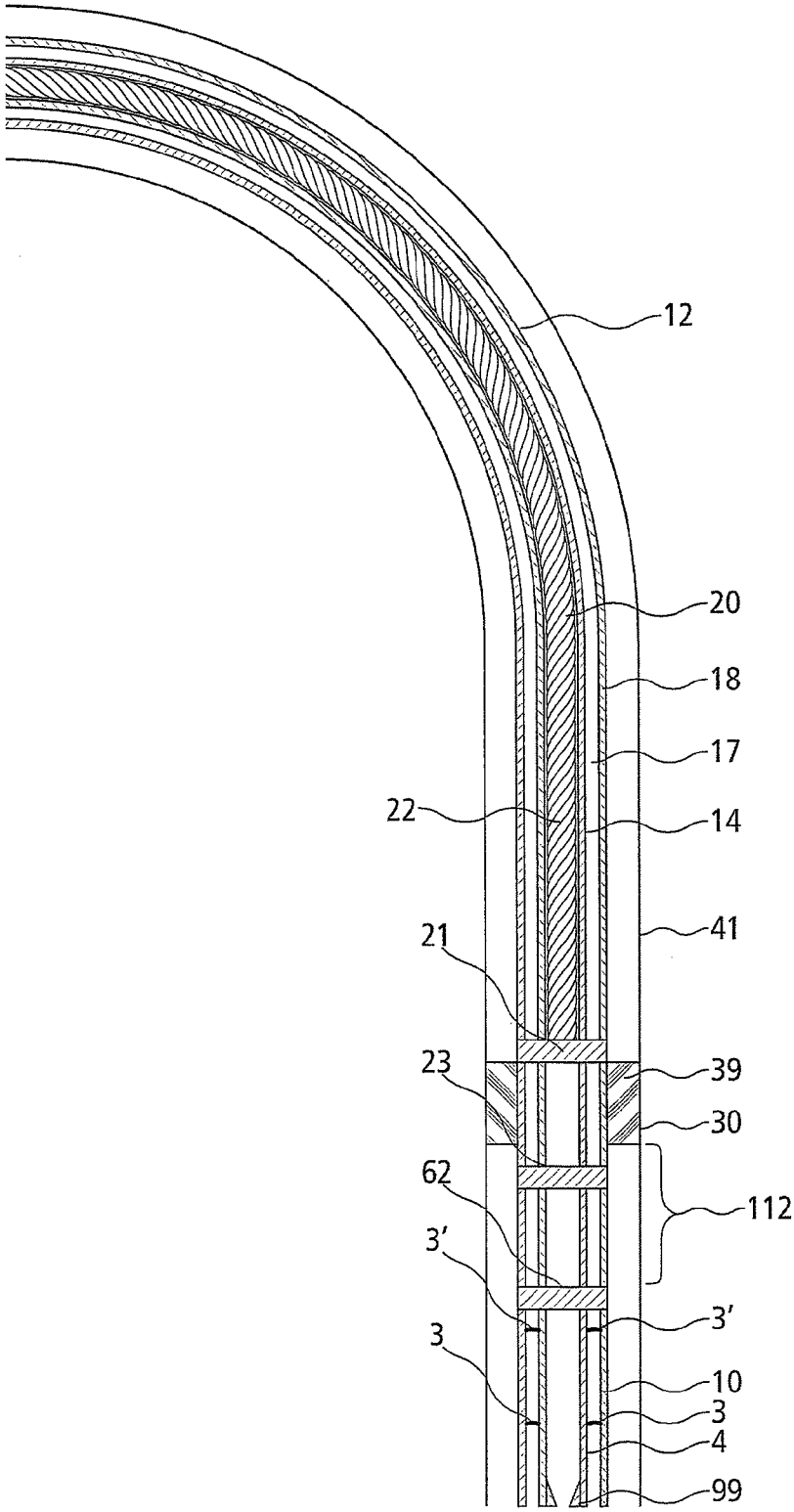
FIG. 8 is a vertical sectional view of an embodiment of a cementing apparatus of the invention when using concentric coiled tubing.

FIG. 8 is a vertical sectional view of another embodiment of a cementing apparatus of the present invention using concentric coil tubing 12. Concentric coiled tubing 12 comprises inner tube 14, which provides inner conduit 20 for pumping cement and water, and outer tube 18, wherein outer tube 14 and inner tube 12 form an annular conduit 17 therebetween for pumping air/fluid during the displacement operations.

Isolation cementing tool 30 is attached to concentric coiled tubing 12 by coupling or connecting means 21, as known in the art for connecting downhole tools to coiled tubing, to be in fluid communication with concentric coiled tubing 12 as previously described with drill pipe. A length of concentric coiled tubing 112 is routinely attached at the end of isolation cementing tool 30 via another connecting means 23 known in the art. The length of concentric coiled tubing 112 is determined based on the length of the zone to be cemented.

Cementing flow control means 10 is attached to the free end of concentric coiled tubing 112 by connecting means 62 as known in the art. As previously mentioned, the inner diameter of the center tube 4 of the cementing flow control means 10 is reduced, forming stinger 99. As mentioned, this reduction in the inside diameter of the center tube prevents cement plug 5 from passing through the center tube and into the wellbore.

Electrical cable 22 provides electric current to operate the isolation cementing tool 30 by expanding and contracting packer means 39. Other means of operating isolation cementing tool 30 could include fiber optic cables, radio frequency, electric magnetic or small diameter capillary tubes which transmit hydraulic or pneumatic pressure.

Figure 9:
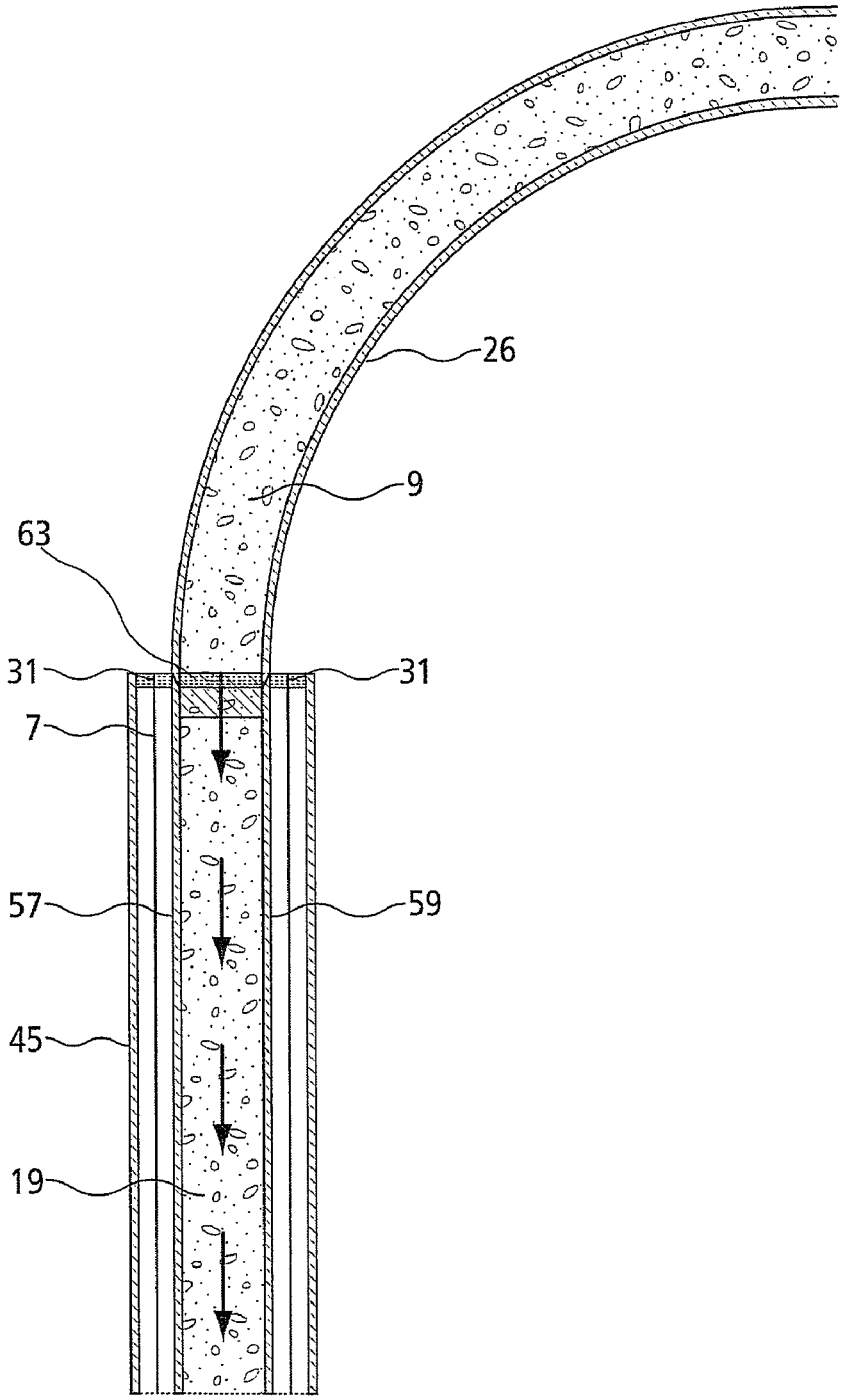
FIG. 9 is a vertical sectional view showing the connection of a single wall high-pressure cement pumping hose to concentric drill string.

FIG. 9 is a vertical sectional view showing the connection of a single wall high-pressure cement pumping hose 26, which can be used to pump cement 9 through the inner conduit 19. Cement pumping hose 26 is connected to inner string 57 of concentric drill string 45 by connecting means 63. Preferably, the annular conduit 7 is sealed off prior to pumping cement 9 down the inner string 57 by means of donut spacer 31. It is understood that donut spacer 31 could be a separate element or could be an integral part of high-pressure cement pumping hose 26. Cement 9 is pumped down the inner string 57 through inner conduit 19 to the desired depth. Cementing flow control means 10 (not shown) prevents cement 9 from flowing back up the annular conduit 7.

Figure 10:
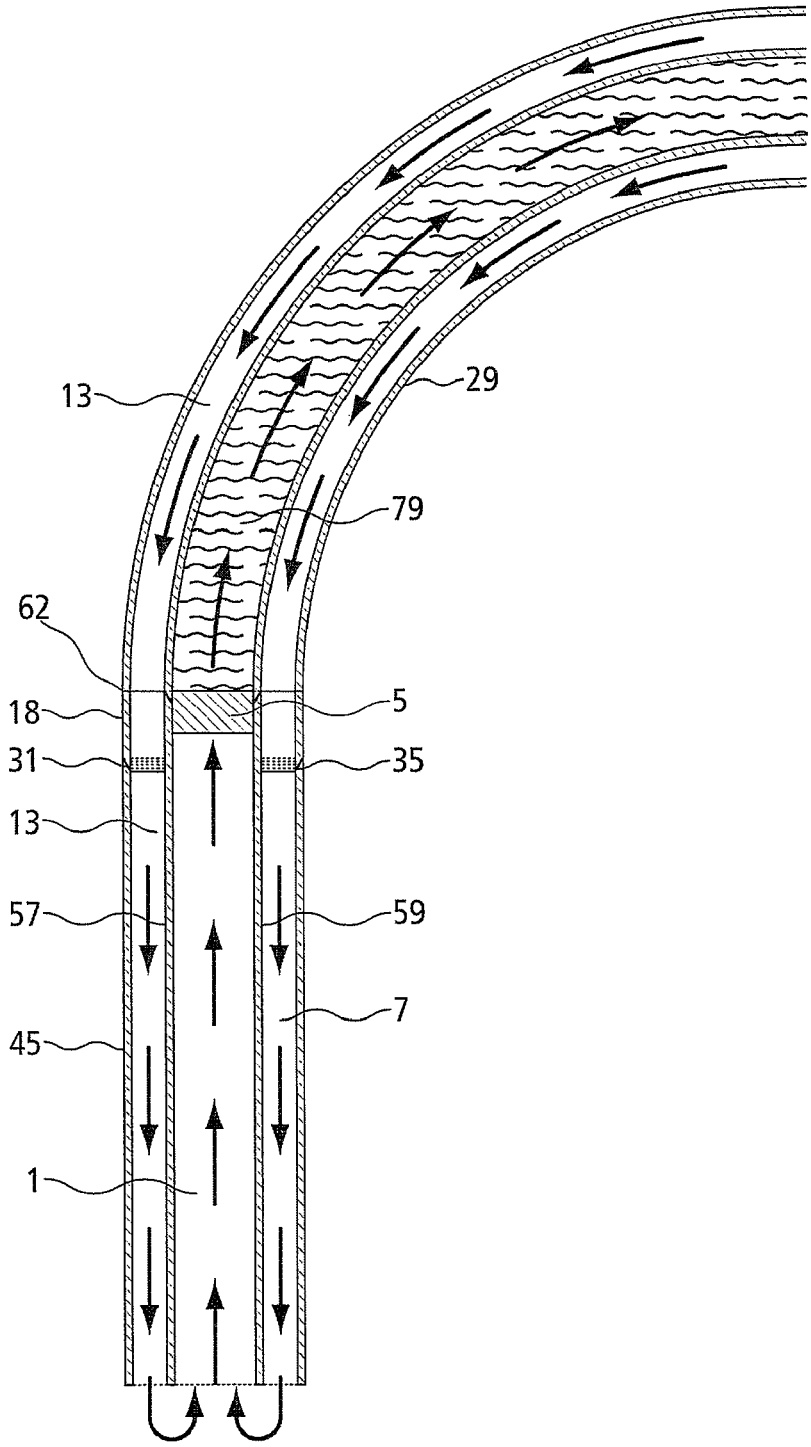
FIG. 10 is a vertical sectional view showing the connection of a double wall high-pressure cement pumping hose to concentric drill string.

FIG. 10 is a vertical sectional view of another embodiment of the invention showing the connection of a double-walled high-pressure cement pumping hose 126 to concentric drill string 45 which can be used for both delivering cement and chasing fluid and also during the displacement of chasing fluid operation. Pin end 31 of double-walled high-pressure cement pumping hose 29 connects to box end 35 of concentric drill string 45 by means of threads as previously described. During displacement operations, fluid such as air 13 is reverse circulated through annular conduit 7 of concentric drill string 45 and up through inner conduit 1, which pushes cement plug 5 and chasing fluid 79 back to surface.

Figure 11:
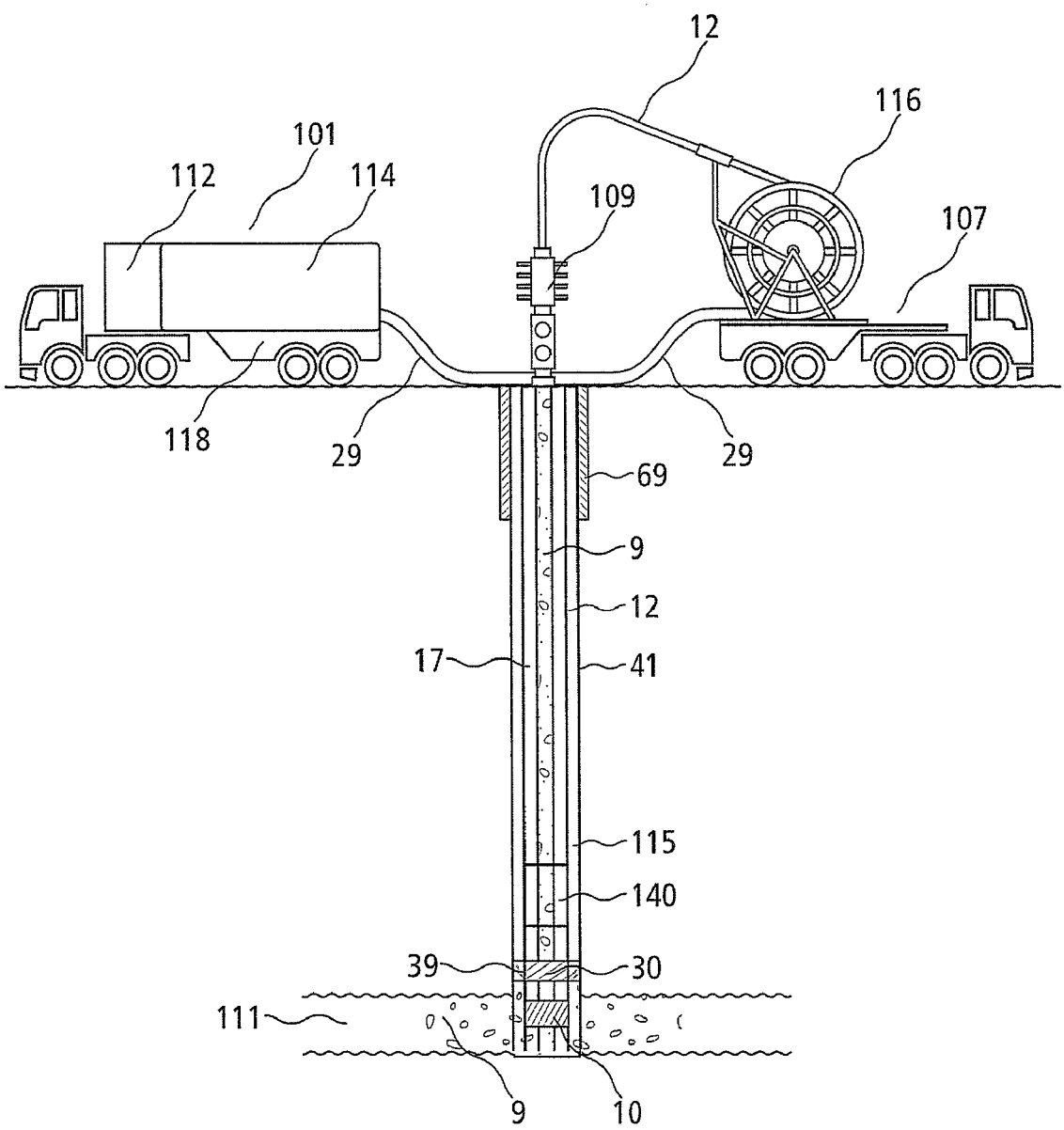
FIG. 11 is a schematic illustration of a concentric coiled tubing unit pumping cement down a wellbore.

In an embodiment as shown in FIG. 11, truck 101 comprises a cement tank 114 for holding cement, a fluid tank 112 for holding fluid such as water, which is used to chase the cement and cement plug to the bottom of the cementing apparatus, and an air compressor 118 for delivering compressed air for displacing the chasing fluid. Truck 101 further comprises a pumping mechanism (not shown) and a valve manifold system (not shown) both of which are connected to cement tank, water tank and air compressor by double-wall cement pumping hose 29. Valve manifold system operates to switch between pumping cement, pumping fluid such as water and pumping air.

Double-wall cement pumping hose 29 connects to concentric coiled tubing 12, which is wrapped around reel 116 on coiled tubing truck 107. In operation, cement 9 is pumped via pumping mechanism through hose 29 and ultimately through either the annular conduit or inner conduit of the concentric drill string 12. Cement 9 is pushed to the bottom of wellbore 115 by adding cement plug (not shown) and pumping fluid such as water from fluid tank 112. This forces cement 9 to be squeezed through formation wall 41 into a fluid zone of the formation required to be sealed off with cement. Once cement 9 has cured or set, it then prevents formation fluid 111 from entering wellbore 115.

Surface blowout preventor (BOP) 109 provides a surface seal for concentric coiled tubing 12 so that pumping pressure can deliver cement 9, water or air down to the wellbore 115 to prevent formation fluid 111 from entering wellbore 115. It can be seen from FIG. 11 that surface casing 69 has previously been cemented in place and the rest of wellbore 115 has been drilled open hole.

Once cementing has been completed, isolation cementing tool 30 is placed in the open position by contracting packer means 39 and concentric coiled tubing 12 and cementing apparatus are pulled up several feet from the top of the cement deposited in the wellbore 115. Then, isolation cementing tool 30 is put back in the closed position by expanding packers means 39 at which point displacement operations are commenced.

Compressed air 13 is now pumped through annular conduit 17 to first assist in drying cement 9 and then to push cement plug and chasing fluid back to the surface where it is returned to fluid tank 112. It is understood that, in addition to compressed air, other chemicals, loss circulation materials and other fluids can also be pumped through annular conduit 17.

Figure 12:
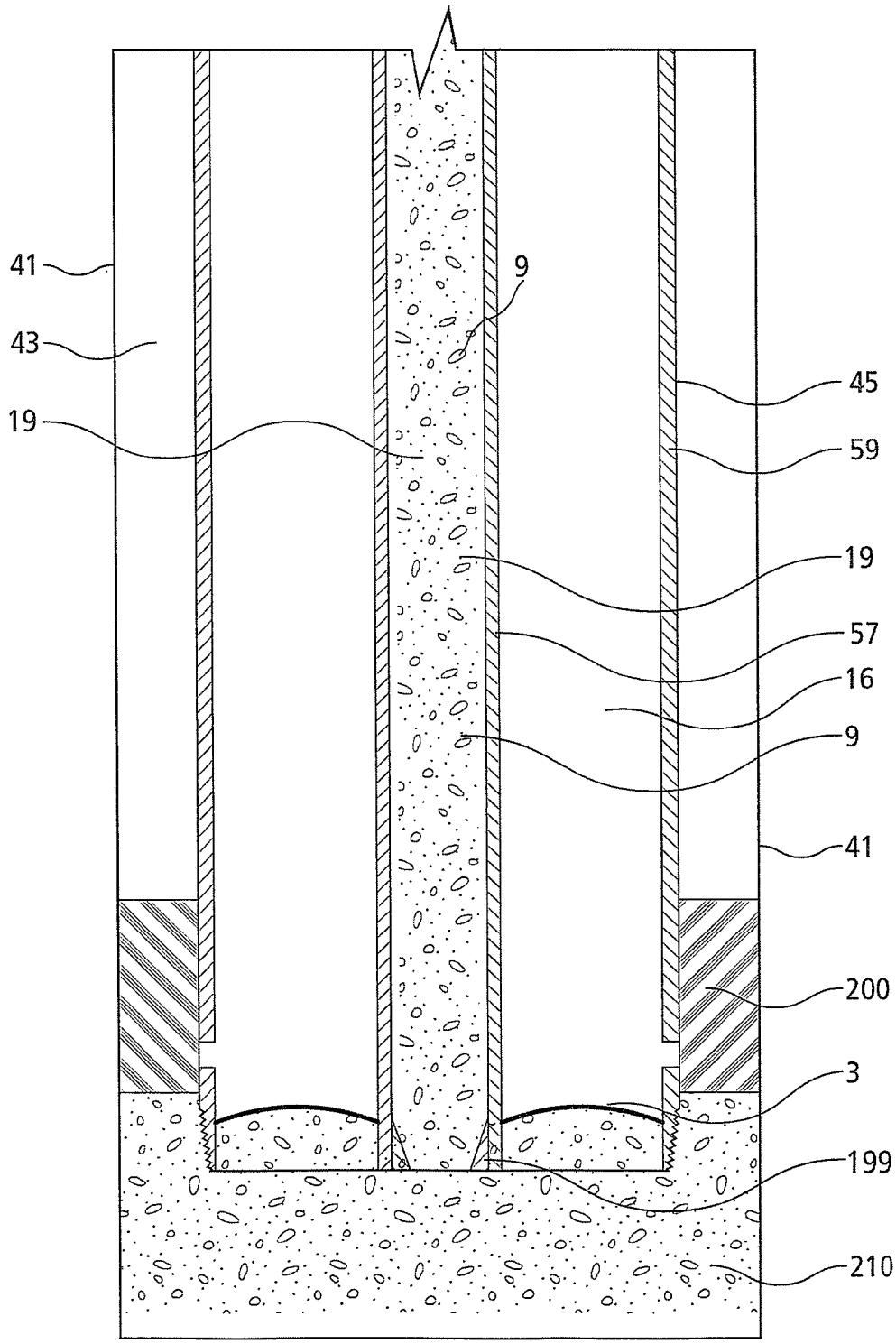
FIG. 12 is a vertical sectional view of another embodiment of the cementing system of the present invention.

FIG. 12 is a vertical sectional view of another embodiment of the present invention. In this embodiment, a cementing system is provided for carrying out the cementing method of the present invention comprising an open hole annular packer means 200, for example, a TAM International inflatable Casing Annulus Packer (CAP™). The packer means is shown in the expanded (inflated) or closed position. As shown in FIG. 12, packer means 200 abuts the wellbore walls 41. Concentric drill string 45, comprising inner string 57 having an inner conduit 19 and outer string 59 forming annular conduit 16, has an outside diameter which allows it to fit snugly within the center of the annular packer means 200. In the alternative, an expandable packer means can be provided which is adapted to surround the outside of the outer string and which can then be lowered down hole together with the concentric drill string for expansion when the zone to be cemented is reached.

In FIG. 12, concentric drill string 45 further comprises valve means 3, which, in this embodiment, is shown in the closed position within the annular conduit 16. Concentric drill string optionally comprises a stinger 199 situated at or near the bottom of the inner string 57. In operation, cement 9 is pumped through inner conduit 19 and into the zone 210 to be cemented. Annular packer means 200 and valve means 3 prevents cement 9 from going up the outer annulus 43 and the annular conduit 16, respectively.

In an embodiment of the invention as shown in F*igure* 5*c* where cement and chasing fluid is delivered through the annular conduit of concentric drill string, it is the radius of the annular conduit 7 of the cementing fluid control means 300 which is reduced, thereby forming an annular conduit stinger 399. In this embodiment, a donut shaped cement plug 305, which has a radius small enough to freely slide through the various annular conduits but large enough that it can not get passed the annular conduit stinger 399 of this embodiment of the cementing fluid control means is used. Fluid such as water 79 is then pumped through the annular conduits to chase down the donut shaped cement plug 305 until it gets lodged in the stinger 399. Compressed fluid such as compressed air 13 is then pumped through the various inner conduits to force the donut shaped cement plug 305 and chasing fluid back to the surface. In this embodiment, the cementing fluid control means comprises a plurality of check valves(310,310') situated in the inner tube 4 rather than the outer conduit 7.

In an embodiment where reverse circulating cementing operations are taking place within zones containing hydrocarbons, a surface and downhole well control system is added for safety reasons to prevent the flow of hydrocarbons to the surface. Examples of cementing operations where well control may be needed are during abandonment of a wellbore, when trying to stop a loss circulation problem, and when squeezing a wet zone or a depleted zone in a multi—zone well. During these reverse circulation cementing operations, the well could "kick" and without the well control downhole and at surface a blow out situation could arise. Examples of surface flow control means and downhole flow control means that can be used with concentric drill string are given in U.S. Pat. No.6,854,534 and U.S. Pat. No. 6,892,829, both of which are incorporated herein by reference. F*igure* 11 shows an embodiment of the invention where both a surface flow control means (surface BOP 109)and downhole flow control means 140 are used.

What is claimed is:

1. An apparatus for cementing a zone in a wellbore formation with cement, comprising:

(a) a first concentric drill string comprising an inner string having an inner conduit and situated within an outer string to form an annular conduit therebetween;

(b) an isolation cementing tool having an expandable and contractible packer means therearound, and adapted to be operably connected to said first concentric drill string such that the isolation cementing tool is in fluid communication with both said conduits; and (c) a cementing flow control device comprising a center tube and an outer casing for stopping or regulating flow through the annular conduit, or the inner conduit and adapted to be operably connected to said first concentric drill string such that the cementing flow control device is in fluid communication with both of said conduits, wherein the inner diameter of said center tube or the inner diameter of said outer casing is reduced at some point, for landing a plug.

2. The apparatus of claim 1 wherein said first concentric drill string comprises joints of concentric drill pipe.

3. The apparatus of claim 1 wherein said first concentric drill string comprises concentric coiled tubing.

4. The apparatus of claim 1 wherein said cementing flow control device is operably connected to said first concentric drill string by being operably connected to the cementing isolation tool.

5. The apparatus of claim 1 further comprising a second concentric drilling string comprising an inner string having an inner conduit and situated within an outer string to form an annular conduit therebetween wherein said second concentric drilling string is operably connected to both said isolation cementing tool and said cementing flow control device.

6. The apparatus of claim 1 wherein said inner string is made from a material selected from the group consisting of rubber, a mixture of rubber and steel, and fiberglass or other composite material and comprises at least one electrical wires for sending an electric current to the isolation cementing tool to expand or contract the packer means.

7. The apparatus of claim 1 wherein said packer means comprises an inflatable ring.

8. The apparatus of claim 7 wherein said inflatable ring expands or contracts by pumping fluids into or out of the inflatable ring.

9. The apparatus of claim 1 further comprising a surface flow control means positioned at or near the surface of the wellbore for preventing the flow of hydrocarbons from the wellbore.

10. The apparatus of claim 1 further comprising a downhole flow control means positioned at or near the bottom of the concentric drill string for preventing the flow of hydrocarbons from the inner conduit, the annular conduit or both to the surface of the wellbore.

11. The apparatus of claim 1 wherein the cementing flow control device comprises at least one valve means.

12. The apparatus of claim 11 wherein said valve means is a check valve.

13. A cementing apparatus for use in cementing operations using concentric drill string, comprising:

(a) an isolation cementing tool comprising a center tube having an inner conduit and an outer casing surrounding the center tube and forming an annular conduit therebetween, said isolation cementing tool further comprising an expandable packer means surrounding the outer casing; and (b) a cementing flow control device comprising a center tube having an inner conduit and an outer casing surrounding the center tube and forming an annular conduit therebetween, said cementing flow control device further comprising a flow restrictor for stopping or regulating flow through the annular conduit or the inner conduit, said flow restrictor being operable to open and close in response to the direction of the flow such that when the direction of the flow is from surface to bottom the flow restrictor is in the open position and when the direction of the flow through the conduit is from bottom to surface the flow restrictor is in the closed position, and said cementing flow control device being adapted to be operably connected to and in fluid communication with the isolation cementing tool.

14. The cementing apparatus of claim 13 wherein the flow restrictor comprises at least one check valve.

15. The cementing apparatus of claim 13 wherein the cementing flow control device is operably connected to the isolation cementing tool by at least one piece of concentric tubing or concentric drill pipe.

16. The cementing apparatus of claim 13 wherein the isolation cementing tool is adapted to be operably connected to a concentric drill string comprising an inner string having an inner conduit and situated within an outer string to form an annular conduit therebetween.

17. A system for cementing a zone in a wellbore, comprising:

(a) an open hole annular expandable packer means;

(b) a concentric drill string having a top and bottom and comprising an inner string having an inner conduit situated within an outer string to form an annular conduit therebetween, said concentric drill string having an outside diameter such that it can be snugly inserted through a center of the annular expandable packer means; and (c) a flow restrictor for stopping or regulating flow positioned at or near the bottom of the concentric drill string in either the annular conduit or the inner conduit, said flow restrictor being operable to open and close in response to the direction of the flow such that when the direction of the flow is from surface to bottom the flow restrictor is in the open position and when the direction of the flow through the conduit is from bottom to surface the flow restrictor is in the closed position

18. A method for cementing a zone in a wellbore formation with cement, comprising:

(a) providing a concentric drill string comprising an inner string having an inner conduit and situated within an outer string to form an annular conduit therebetween;

(b) pumping cement down one of the inner or annular conduits of the concentric drill string to the zone to be cemented;

(c) sealing off an outside annulus formed between a wall of said wellbore and an outer surface of said concentric drill string at a position above the zone desired to be cemented to prevent the flow of cement therethrough from the zone; and (d) sealing off the other of the inner or annular conduits of the concentric drill string to prevent the flow of cement therethrough from the zone.

19. The method of claim 18 further comprising adding a cementing plug to the unsealed conduit after all the cement has been pumped therein.

20. The method of claim 19 further comprising pumping a first fluid through the unsealed conduit after the addition of the cementing plug to assist in pushing the cement through the unsealed conduit and into the zone in the wellbore formation.

21. The method of claim 20 further comprising preventing the cementing plug from exiting into the wellbore.

22. The method of claim 21 further comprising opening the sealed conduit and pumping a second fluid therethrough such that the second fluid is reverse circulated back up the unsealed conduit thereby removing the cementing plug and first fluid from the unsealed conduit to the surface of the wellbore.

23. The method of claim 18 further comprising:

(e) opening the sealed conduit after pumping the cement and pumping a cement curing composition therethrough.

24. The method of claim 23 wherein the cement curing composition comprises a gas.

25. The method of claim 18 further comprising:

(e) unsealing the outer annulus when pumping of the cement into the zone is completed;

(f) lifting the concentric drill string to a distance above the cemented zone and resealing the outer annulus; and (g) opening the sealed conduit of the concentric drill string and pumping a gas therethrough to cure the cement.

26. The method of claim 18 wherein the outside annulus is sealed off by means of an expandable and contractible packer means.

27. The method of claim 26 wherein said packer means is expanded and contracted by means of an electrical current.

28. The method of claim 26 wherein said packer means is expanded and contracted by the addition of fluid into or the removal of fluid out of the packer means.

29. The method of claim 18 wherein the other of the inner or annular conduits of the concentric drill string are sealed off by means of at least one valve means.

30. The method of claim 18 wherein said concentric drill string comprises joints of concentric drill pipe.

31. The method of claim 18 wherein said concentric drill string comprises concentric coiled tubing.

32. The method of claim 18 further comprising providing a downhole flow control means positioned at or near the bottom of the concentric drill string for preventing flow of hydrocarbons from the inner conduit, the annular conduit or both to the surface of the wellbore.

33. The method of claim 18 further comprising providing a surface flow control means positioned at or near the surface of the wellbore for preventing flow of hydrocarbons from the outside annulus.

34. A concentric drill string for use in cementing a zone in a wellbore, the concentric drill string having an inner string having an inner conduit and situated within an outer string to form an annular conduit therebetween, comprising:

(a) an expandable packer means surrounding the outer string at or near a bottom end of the concentric drill string; and (b) a flow restrictor for stopping or regulating flow positioned at or near the bottom of the concentric drill string in either the annular conduit or the inner conduit, said flow restrictor being operable to open and close in response to the direction of the flow such that when the direction of the flow is from surface to bottom the flow restrictor is in the open position and when the direction of the flow through the conduit is from bottom to surface the flow restrictor is in the closed position.

* * * * *